US008830133B2

(12) United States Patent
Weily et al.

(10) Patent No.: US 8,830,133 B2
(45) Date of Patent: Sep. 9, 2014

(54) CIRCULARLY POLARISED ARRAY ANTENNA

(75) Inventors: Andrew Reginald Weily, Epping (AU); Yingjie Jay Guo, Epping (AU); Ian Maxwell Davis, Bella Vista (AU); John Seward Kot, North Narrabeen (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 979 days.

(21) Appl. No.: 12/866,137

(22) PCT Filed: Feb. 2, 2009

(86) PCT No.: PCT/AU2009/000121

§ 371 (c)(1),
(2), (4) Date: Dec. 8, 2010

(87) PCT Pub. No.: WO2009/097647

PCT Pub. Date: Aug. 13, 2009

(65) Prior Publication Data

US 2011/0090129 A1 Apr. 21, 2011

(30) Foreign Application Priority Data

Feb. 4, 2008 (AU) ..... 2008900495

(51) Int. Cl.

| | |
|---|---|
| ***H01Q 21/24*** | (2006.01) |
| ***H01Q 13/10*** | (2006.01) |
| ***H01Q 1/38*** | (2006.01) |
| ***H01Q 21/06*** | (2006.01) |
| *H01Q 21/00* | (2006.01) |

(52) U.S. Cl.

CPC ..... *H01Q 21/064* (2013.01); *H01Q 21/24* (2013.01); *H01Q 1/38* (2013.01); *H01Q 21/0075* (2013.01); *H01Q 13/106* (2013.01)

USPC ..... 343/770; 343/767

(58) Field of Classification Search

CPC ..... H01Q 21/064; H01Q 21/24; H01Q 19/10; H01Q 1/38

USPC ..... 343/770–771

See application file for complete search history.

(56) References Cited

U.S. PATENT DOCUMENTS

| | | | | |
|---|---|---|---|---|
| 4,843,400 | A | 6/1989 | Tsao et al. | |
| 5,661,494 | A | 8/1997 | Bondyopadhyay | |
| 6,198,437 | B1 * | 3/2001 | Watson et al. | 343/700 MS |

FOREIGN PATENT DOCUMENTS

| | | |
|---|---|---|
| EP | 0 434 268 B1 | 6/1991 |
| EP | 0 507 307 A2 | 10/1992 |

OTHER PUBLICATIONS

Abdulhadi, A.E., et al., "Single Feed Circularly Polarized Microstrip Antenna and Array," Antennas and Propagation International Symposium, IEEE, pp. 713-716 (Jun. 1, 2007).

(Continued)

*Primary Examiner* — Robert Karacsony
*Assistant Examiner* — Amal Patel
(74) *Attorney, Agent, or Firm* — Kilpatrick Townsend & Stockton LLP

(57) ABSTRACT

A circularly polarized array antenna (30) is disclosed. A single layer dielectric substrate (36) has a ground plane (32) located on its upper surface of the substrate and covering only part of the upper surface. A plurality of antenna elements (40-54) are also located on said upper surface of the substrate. Each antenna element has a slot element (60-74) formed in the ground plane and a respective loading element (80-94) located within each slot element. The antenna elements being arranged in a regular array where each respective slot element is sequentially rotated in space with respect to adjacent slot elements, and the loading elements generate a perturbation under excitation. A microstrip feed network (100) is located on the underside of the substrate to provide excitation to each slot element, and including feeds of different lengths to be electrically sequentially rotated in common with spatial rotation of the slot elements. A single microstrip feed point (108) extends to the edge of the substrate for connection purposes. A reflecting plane is located parallel to and spaced apart from the underside of the substrate. The ground plane extends to cover the entire microstrip feed array.

5 Claims, 16 Drawing Sheets

(56) References Cited

OTHER PUBLICATIONS

Lo, W.K., et al., "Circularly polarised microstrip antenna array using proximity coupled feed," Electronic Letters, vol. 34, No. 23, pp. 2190-2191 (Nov. 12, 1998).
Kin-Lu Wong, et al., "A Circularly Polarized Patch-Loaded Square-Slot Antenna," In: Microwave and Optical Technology Letters, vol. 23, No. 6, pp. 363-365, (Dec. 20, 1999).
Hall, P.S., et al., "Application of sequential feeding to wide bandwith, circularly polarised microstrip patch arrays," IEE Proceedings, vol. 136, Pt. H., No. 5, pp. 390-398 (Oct. 1989).
Hall, P.S., et al., "Design principles of sequentially fed, wide bandwith, circularly polarised microstrip antennas," IEE Proceedings, vol. 136, Pt. H, No. 5, pp. 381-389 (Oct. 1989).
Kin-Lu Wong, et al., "A Circularly Polarized Patch-Loaded Square-Slot Antenna", *Microwave and Optical Technology Letters*, vol. 23, No. 6, pp. 363-365 (Dec. 20, 1999).
International Report on Patentability issued on Aug. 10, 2010 for International Patent Application No. PCT/AU2009/000121, 6 pages.
Uchimura et al., "Novel Circular Polarized Antenna Array Substrates for 60GHz-band" *2005 IEEE MTT-S International Microwave Symposium Digest*, pp. 1875-1878, Jun. 12-17, 2005.
Schoebel et al., "Design Considerations and Technology Assessment oh Phased-Array Antenna Systems With RF MEMS for Automotive Radar Applications", IEEE Transactions on Microwave Theory and Techniques, vol. 53, No. 6, pp. 1968-1975 (2005).
Freese et al., "Synthesis of Microstrip Series-Fed Patch Arrays for 77 GHz-Sensor Applications", *Asia Pacific Microwave Conference*, pp. 29-33, Dec. 3-6, 2000.

* cited by examiner

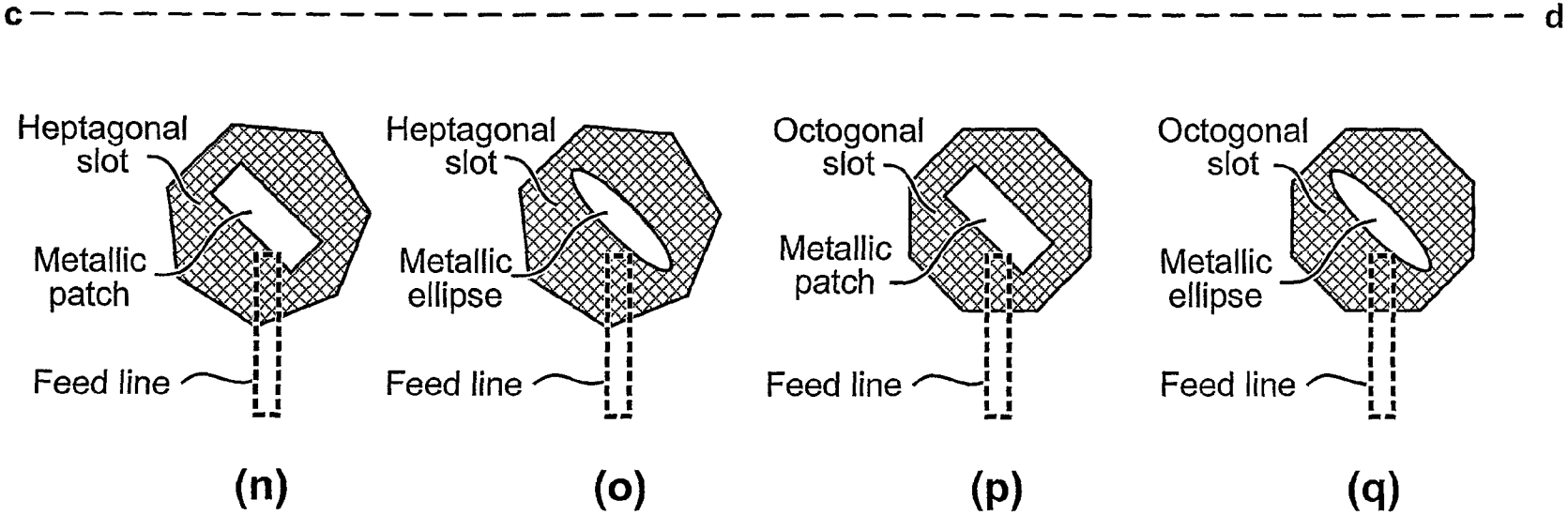
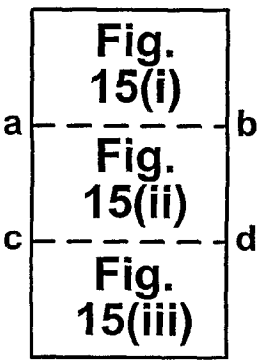
Fig. 15(iii)

CIRCULARLY POLARISED ARRAY ANTENNA

CROSS-REFERENCES TO RELATED APPLICATIONS

This application is a National Stage of International Application No. PCT/AU2008/000121 filed Feb. 2, 2009, and which claims the benefit of Australian Patent Application No. 2008900495, filed Feb. 4, 2008, the disclosures of which are incorporated herein by reference.

FIELD OF THE INVENTION

The invention relates to circularly polarized array antennas.

BACKGROUND

There is a commercial demand for antennas that operate in the millimeter wave region, equating to frequencies in the range 30-300 GHz. Such antennas find application in Wireless Personal Area Networks (WPANs) used in the wireless transmission of high definition television data and for high-speed internet access, and also in video on demand and short-distance high data-rate transmission used to replace fixed cabling.

A similar demand also exists for antennas that operate below millimeter wavelengths, down to 1 GHz, for use in Wireless Local Area Networks (WLANs).

Circularly polarised antennas are of interest because they do not need to be aligned/oriented in the way that do linearly polarised antennas to send or receive radio waves. A circular polarised antenna need only be directed towards another circularly (or linearly) polarised antenna.

Known circularly polarised antennas operating at millimeter wave frequencies typically rely upon Low-Temperature Cofired-Ceramic (LTCC) materials, and use arrays of apertures fed by waveguide feed networks, such as that described in Uchimura, H., Shino, N., and Miyazato, K., "Novel circular polarized antenna array substrates for 60 GHz-band," 2005 *IEEE MTT-S International Microwave Symposium Digest*, pp. 1875-1878, 12-17 Jun. 2005.

Another example of a circularly polarized antenna is taught by K.-L. Wong, J.-Y. Wu and C.-K. Wu, "A circularly polarized patch-loaded square-slot antenna", *Microwave and Optical Technology Letters*, vol 23, no. 6, pp. 363-365, Dec. 20, 1999. Wong et al teaches a patch-loaded square-slot antenna that uses a rectangular patch as the perturbation element for the excitation by a slot of two orthogonal, phase shifted resonant modes of circularly polarized radiation.

It is also of interest to achieve high-gain and wide bandwidth in circularly polarized antennas, which can not be achieved by the two exemplary known antennas referred to immediately above.

U.S. Pat. No. 4,843,400, Tsao et al, issued on Jun. 27, 1989, teaches an array of radiating patch elements mounted on a single waveguide that enables the synthesis of a larger aperture than would be the case for a single antenna element.

A paper by P. S. Hall, "Application of sequential feeding to wide bandwidth, circularly polarised microstrip patch arrays", *IEE Proc.*, Vol. 136, Pt. H, No. 5, October 1989, pp. 390-398, describes the sequential rotation of the feeding of circularly polarised microstrip patch antennas and arrays coupled with appropriate offset of the feeding phase leads to significant improvements both in bandwidth and purity.

SUMMARY

It is an object of the invention to substantially achieve and improve upon one or more high gain and wide bandwidth, to be susceptible of cost-effective mass production, or to provide a useful alternative.

Accordingly, there is provided an antenna comprising:

a single layer dielectric substrate;

a ground plane located on the upper surface of the substrate and covering only part of said upper surface;

a plurality of antenna elements also located on said upper surface of the substrate, each antenna element having a slot element formed in the ground plane and a respective loading element located within each slot element, said antenna elements being arranged in a regular array where each respective slot element is sequentially rotated in space with respect to adjacent slot elements, and said loading elements generate a perturbation under excitation;

a microstrip feed network located on the underside of the substrate to provide excitation to each slot element, and including feeds of different lengths to be electrically sequentially rotated in common with spatial rotation of said slot elements, and a single microstrip feed point extending to an edge of said substrate for connection purposes; and a reflecting plane located parallel to and spaced apart from the underside of the substrate; and wherein said ground plane extends to cover the entire microstrip feed array.

Preferably, the ground plane covers the substrate to the extent that at least ½ wavelength at an operational frequency between the edges of the ground plane and the edges of the substrate is not covered, except where said ground plane covers said feed point. The reflector typically is at least as large in surface area as said substrate. The regular array typically is at least of dimensions 2×1. A housing that supports said substrate at the substrate edges and supports or incorporates said reflector can be provided. The substrate typically is formed of a liquid crystal polymer material.

Other aspects are disclosed.

DETAILED DESCRIPTION

Introduction

Figure 1A:
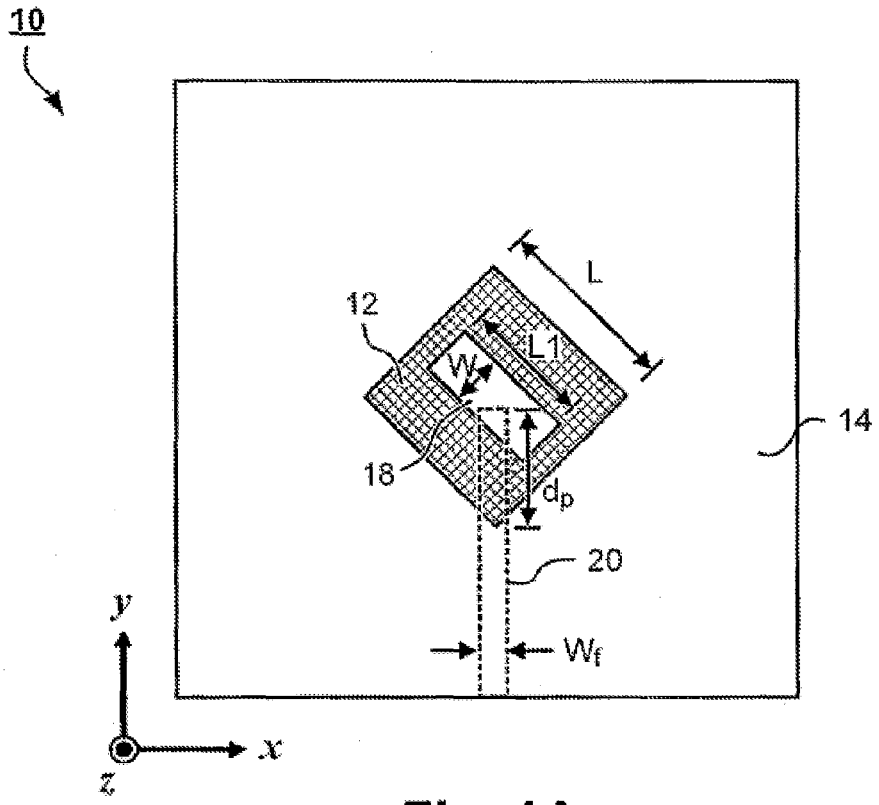
Fig. 1A (PRIOR ART)
FIGS. 1A and 1B are plan and elevation views respectively of a known patch-loaded square slot antenna element.
Figure 1B:
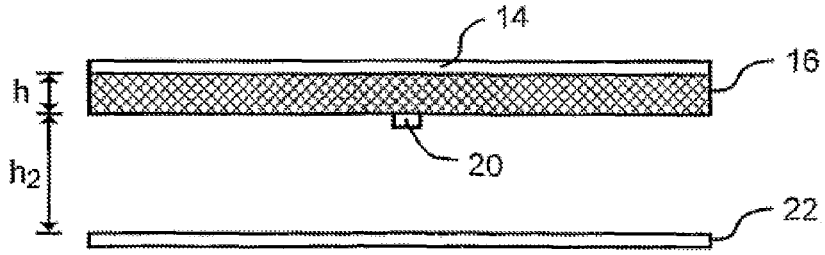
Fig. 1B (PRIOR ART)

FIGS. 1A and 1B show the known antenna element taught by Wong et al, referred to above. The antenna 10 consists of a square slot 12, of length L, formed in a ground plane 14. The ground plane 14 is formed by metalisation contacted to the surface of a liquid crystal polymer (LCP) substrate 16. The substrate 16 is of thickness h. The slot's major axes are rotated by 45 degrees with respect to the edge of the ground plane 14. The slot 12 is loaded with a conducting rectangular patch 18 of dimensions w by L1. The slot 12 is fed by a microstrip line 20 with a width of $W_p$, which is contacted on the opposite side of the substrate 16 to the slot 12. The length $d_p$ of the probe portion of the feed line 20 allows tuning of the impedance of the antenna 10.

A conductive reflector 22 is located at a distance $h_2$ from the lower face of the substrate 16. The reflector 22 limits the radiation of the slot antenna to the positive z direction. Without the reflector 22 being present, the antenna 10 will radiate almost equally in both the positive and negative z directions. The distance $h_2$ is typically a quarter of a wavelength long at the centre frequency of the design bandwidth.

By adjusting the ratio of length to width (L1/w) of the patch 18, a perturbation of the symmetry of the slot 12 is achieved, such that it is then possible to excite two orthogonal modes in the rectangular slot 12 that couple together with the correct phase shift to generate circularly polarized radiation. A typical value for L1/w is 2.6. L1 is typically 0.7 L.

4×2 Array Embodiment

Figure 2:
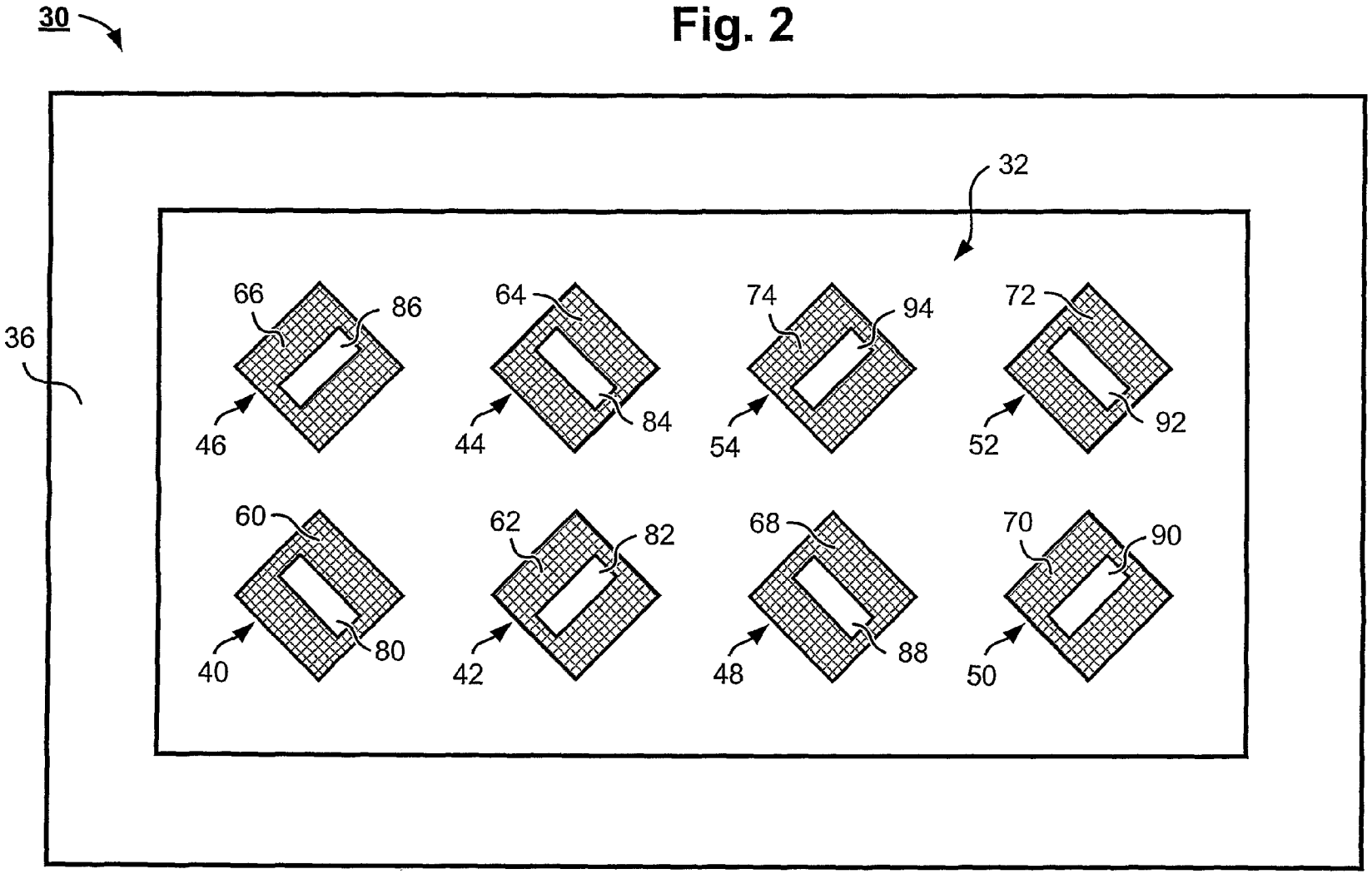
FIG. 2 is a partial view of a 4×2 array antenna assembly embodiment.

FIG. 2 is a plan view of a constituent assembly 30 of a 4×2 array of patch-loaded square slot antenna. This assembly 30 has been designed to operate from 57 to 66 GHz for Wireless Personal Area Network (WPAN) applications. The dimensions of the ground plane 32 are length=16.34 mm and width=8.17 mm. The single layer dielectric substrate 36 has the dimensions of length=24 mm and width=15.83 mm, and thickness of 100 μm. The substrate 36 is formed of a LCP material, having a dielectric constant=3.2 and tan δ=0.004. A suitable substrate is the Rogers ULTRALAM 3850, or Nippon Steel Chemical Co. Ltd, Espanex L Series.

As is apparent, the ground plane 32 extends only over a portion of the total surface area of the substrate 36. This is important in terms of packaging the antenna in a housing, as will be described below. The distance between the edge of the ground plane 32 and the edge of the substrate 36 should be at least a ½ wavelength to avoid the housing unduly influencing the radiation characteristics of the assembly 30.

The area occupied by the ground plane generally is optimised to give best antenna performance by numerical simulation software. In general, the size is proportional to the array spacing, the number of array elements and the type of slot and substrate material.

The antenna assembly 30 has eight antenna elements 40-54 (each equivalent to the antenna 10 of FIG. 1), each consisting of a slot 60-74 and a loading element in the form of a patch 80-94. The antenna elements 40-54 are sequentially rotated in space about a common slot axis.

A typical range for the dimension of the square slots 60-74 is 1.69 mm to 1.86 min. A typical range for the dimensions of the patches 80-94 is 1.22 mm to 1.45 mm×0.43 mm to 0.48 mm. The antenna element separation of the array is typically 3.86 mm (0.79λ, at 61.5 GHz) in the x-direction, and 3.41 mm (0.702 at 61.5 GHz) in the y-direction.

A metallization thickness of 9 μm is used for the ground plane 32, the patches 80-86 and the feed network 100. The conductivity of the metallization is $3\times10^7$S/m.

The reflector (not shown) located below the substrate 36 should have equal or larger dimensions than the substrate 36, and be separated by a typical air gap of 1.25 mm.

Figure 3:
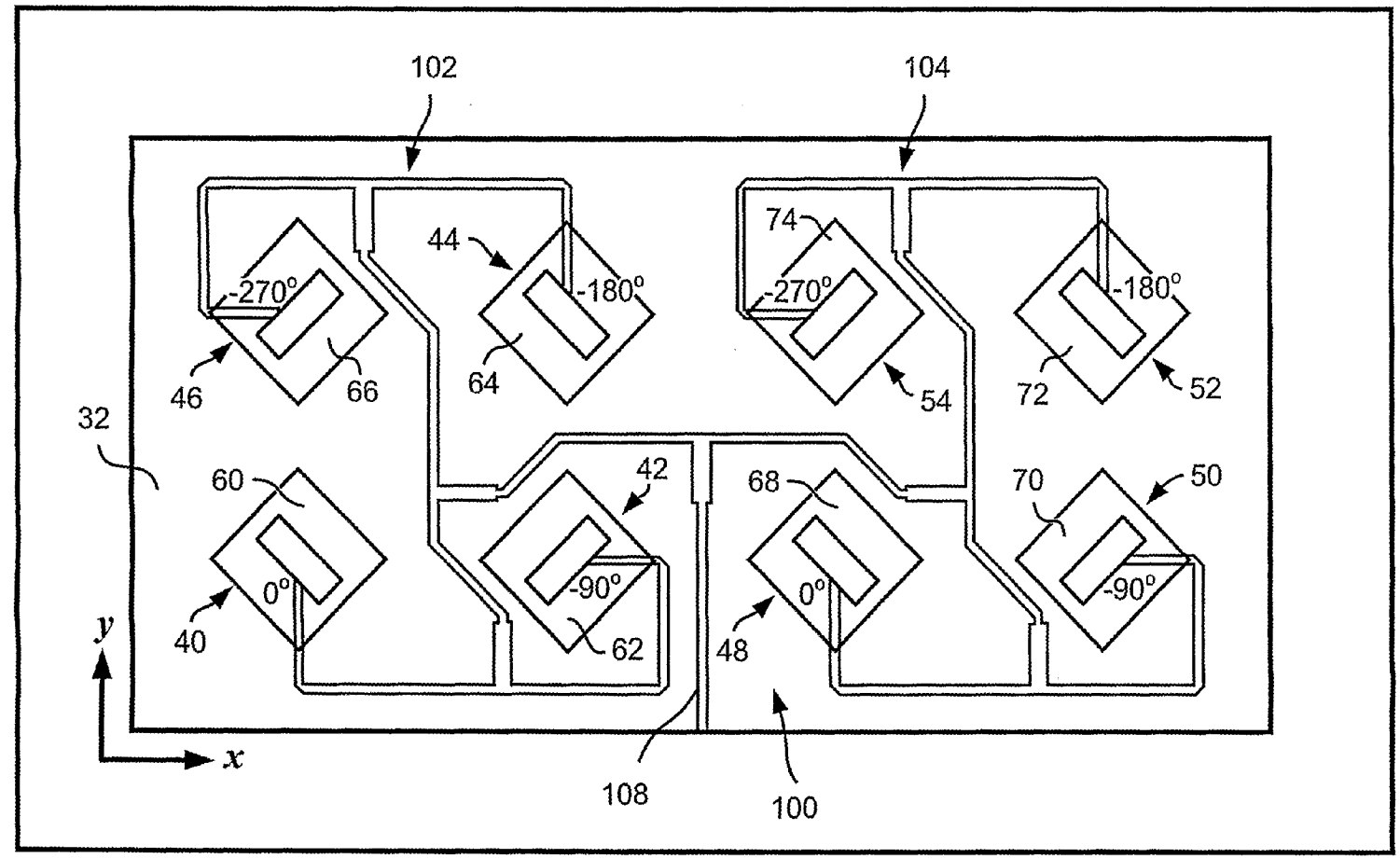
FIG. 3 is a plan view of the 4×2 array antenna assembly showing the microstrip feed network.

FIG. 3 shows the microstrip feed network 100 on the underside of the substrate 36 with the ground plane 32 and the 4×2 array of patch-loaded square slot antenna elements 40-54 shown in phantom, and superimposed onto the feed network 100 to show their relative positions. The relative (electrical) phase shifts provided by the feed network 100 are given for each antenna element 40-54. These phase shifts coincide with the spatial sequential rotation of the rectangular patches 80-94. The angle between the respective probe and slot 60-74 is at substantially 45° to the major axes of the slot. Variations of between +/−1° to +/−5° can be tolerated.

The feed network 100 is formed as two (2×2) sub-arrays 102, 104, constituted by a series of power dividing T-junctions beginning with the principal junction 106 from the input feed line 108. The characteristic impedance of the microstrip feed network 100 is approximately 71Ω (excluding T-junctions), corresponding to a line width of 123 μm on an LCP substrate with a height of 100 μm. The lengths of the individual feeds to each antenna element 40-54 vary to achieve an electrical delay, leading to a relative phase difference, as indicated.

The antenna assembly 30 can be fabricated using known photolithography techniques, where the substrate 36 initially has full metallisation on both surfaces, and the metallisation is appropriately removed to create the ground plane 32, patches 80-94, and feed network 100.

Each of the 2×2 sub-arrays 102, 104 uses sequential rotation of the antenna elements to increase the axial ratio bandwidth. The feed network delivers equal amounts of energy to the antenna elements 40-54. The phase delay of each element in the 2×2 sub-array is sequentially increased by 90° (ie 0°, 90°, 180°, 270°) as the elements are rotated in space about a common square slot axis. This sequential rotation increases the overall axial ratio bandwidth for the individual sub-arrays 102, 104. By using two arrays, the overall gain of the antenna is increased compared to one, and the beamwidth of the radiation pattern is narrowed (in the ϕ=0° plane in this case).

The designed performance of the array antenna assembly 30 is as follows:

- Minimum realised gain (57-66 GHz): 14.7 dBic
- Maximum axial ratio (57-66 GHz): 2.84 dB
- Maximum reflection coefficient, $S_{11}$ (57-66 GHz) −14.9 dB
- Impedance bandwidth (where the reflection coefficient is less than −10 dB) extends from 49.16 GHz to 77.16 GHz (44%).

The antenna assembly 30 is believed to have good insensitivity to tolerance errors in manufacturing, and particularly in shifts of the metallisation patterns in the top and bottom surfaces of the LCP substrate of up to ±100 μm. This is particularly advantageous where low-cost manufacture is desired where tolerances may not be closely controlled.

Figure 4:
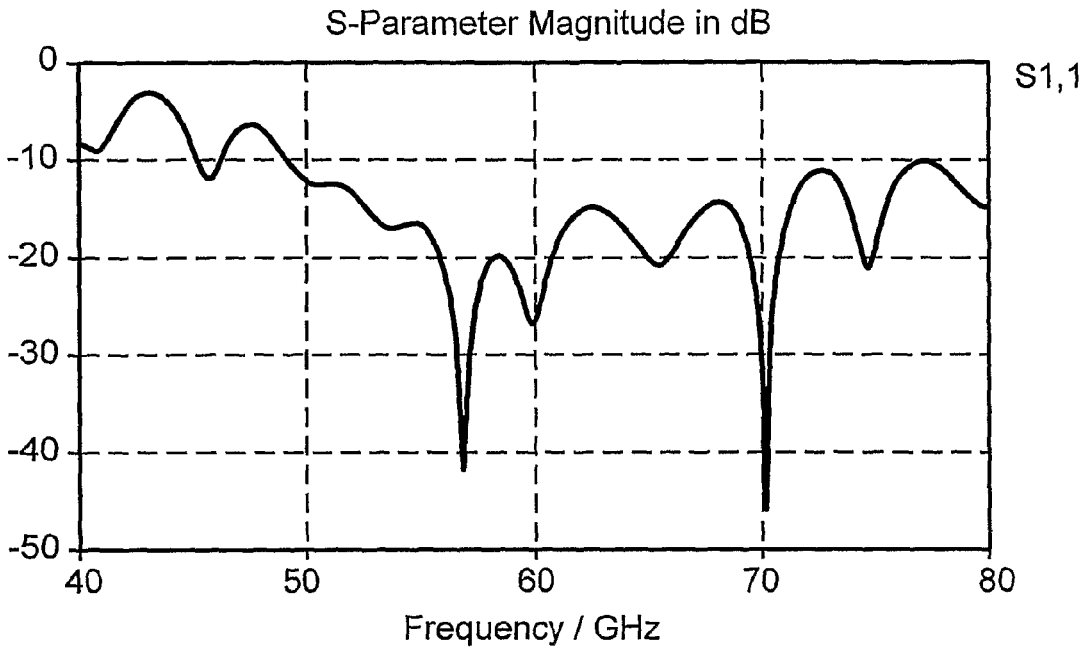
FIG. 4 is a computed reflection coefficient at the input of the 4×2 array antenna assembly.

FIG. 4 is a plot of computed reflection coefficient at the input (i.e. the end of the feed line 108) for the antenna assembly 30. The reflection coefficient is less than −14.9 dB over the specified bandwidth of operation, thus providing a well-matched connection/interface to a silicon integrated circuit.

Figure 5:
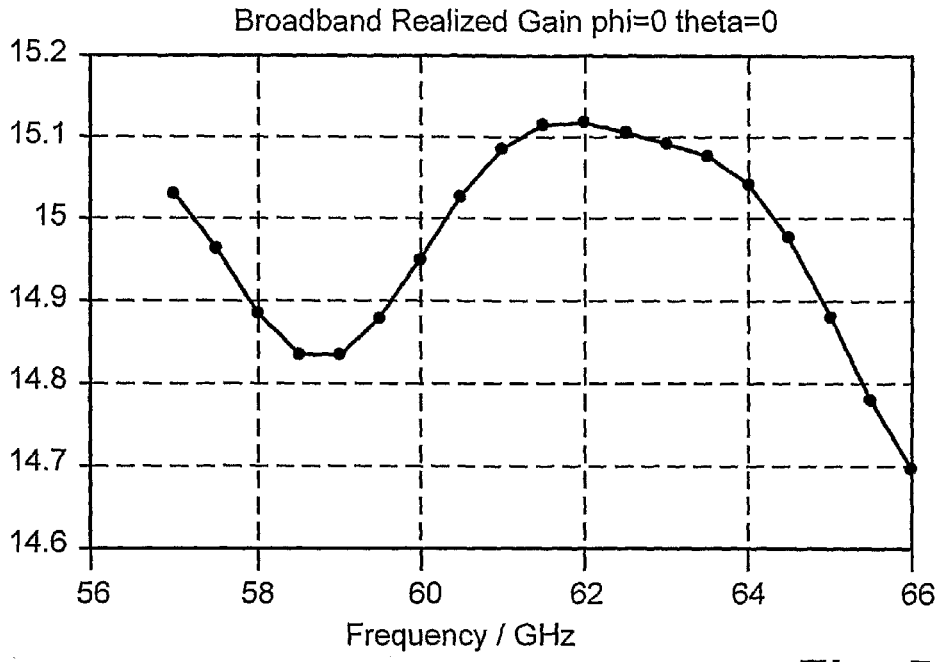
FIG. 5 is a computed realised gain of the 4×2 array antenna assembly.

FIG. 5 is a computed realised gain for the antenna 30 assembly. The realised gain is greater than 14.7 dBic over the specified operating bandwidth to provide the necessary signal level for typical WPAN applications, such as transmission of HDTV signals.

Figure 6:
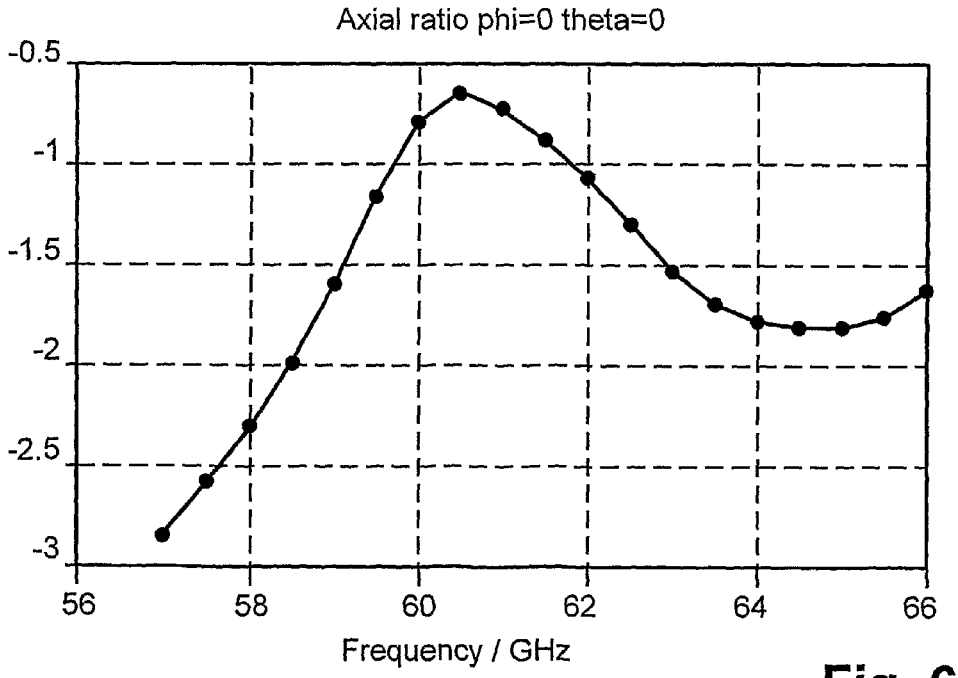
FIG. 6 is a computed axial ratio of the 4×2 array antenna assembly.

FIG. 6 is a computed axial ratio of the antenna assembly 30. The axial ratio is less than 2.84 dB over the specified bandwidth, thus ensuring the purity of the circularly polarized radiation, and reduces antenna orientation errors associated with linearly polarized antennas.

Figure 7:
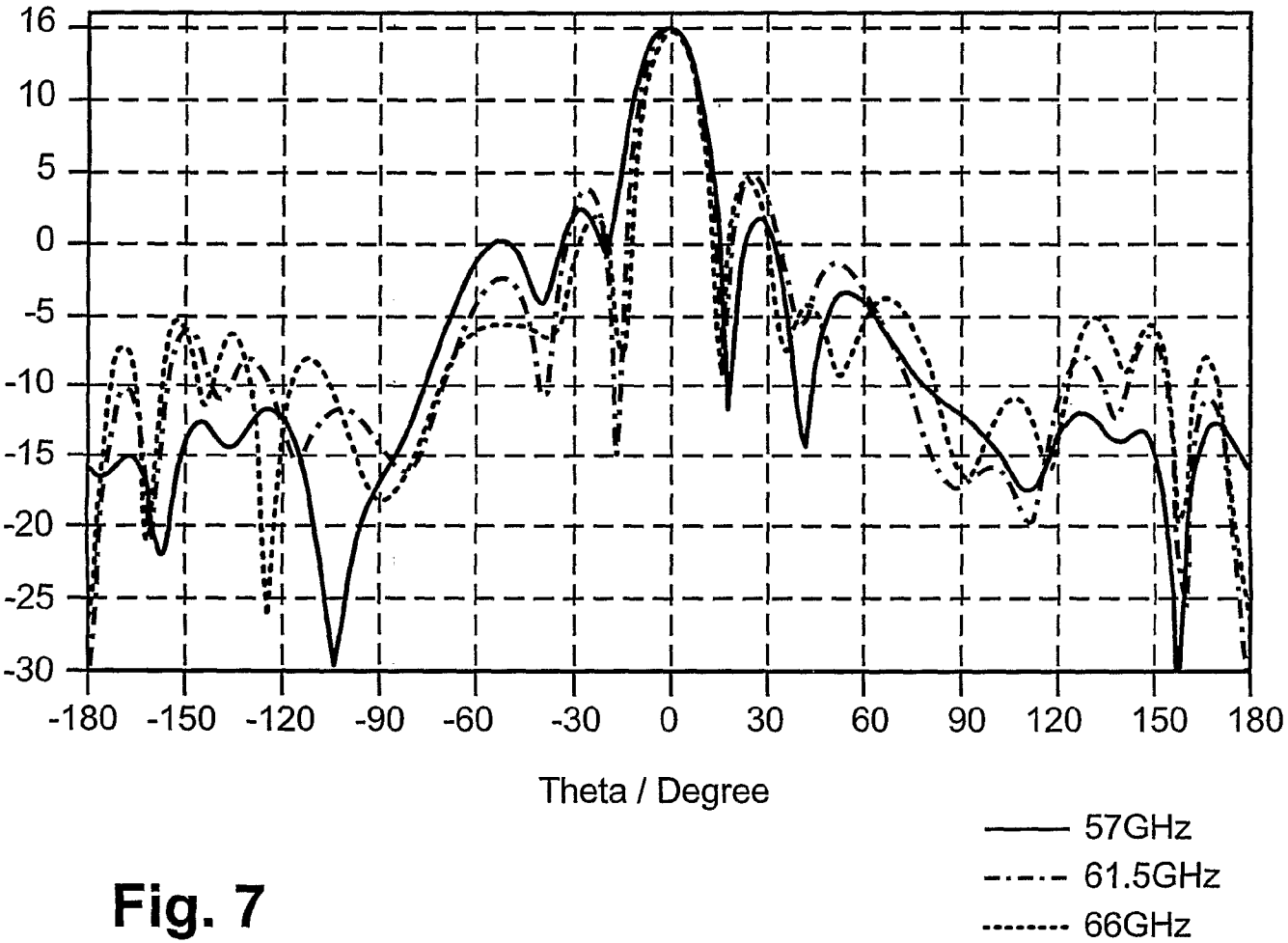
FIG. 7 shows computed RHCP radiation patterns of the 4×2 array antenna assembly at $\phi=0°$.

FIG. 7 is a computed right hand circularly polarised radiation pattern for the antenna assembly 30 at $\phi=0°$ (being the x-z plane in FIG. 3). Sidelobe levels are below −10 dB across the specified bandwidth, and the beamwidth of the radiation patterns is narrower than that of the $\phi=90°$ plane (y-z plane), deemed suitable for WPAN applications.

Figure 8:
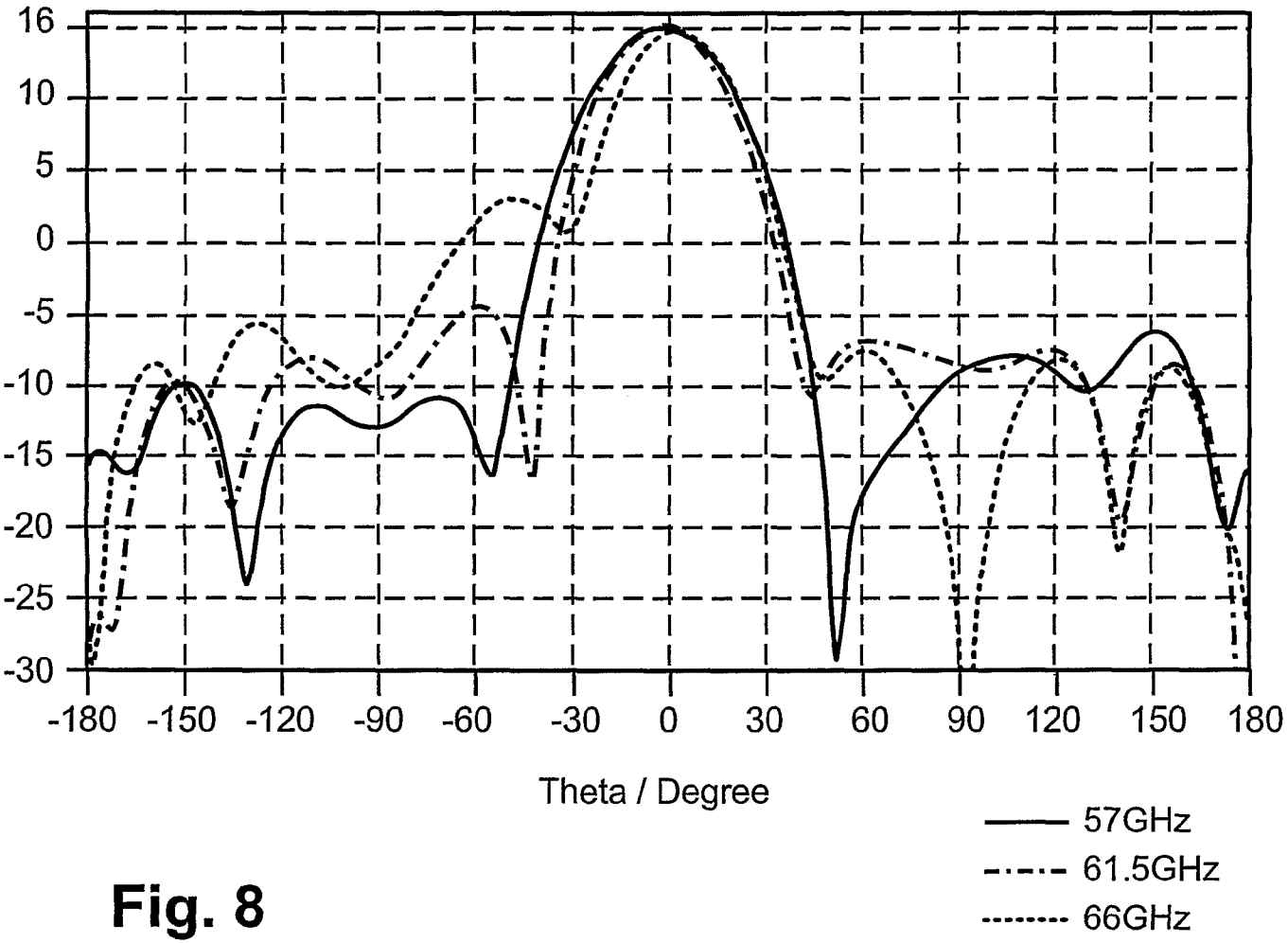
FIG. 8 shows computed RHCP radiation patterns of the 4×2 array antenna assembly at $\phi=90°$.

FIG. 8 is a computed right hand circularly polarised radiation pattern for the antenna assembly 30 at $\phi=90°$ (being the y-z plane in FIG. 3). Sidelobe levels are below −10 dB across the specified bandwidth, and the beamwidth of the radiation patterns is relatively wide ensuring that alignment of antennas in a WPAN application is relatively easy.

Figure 9:
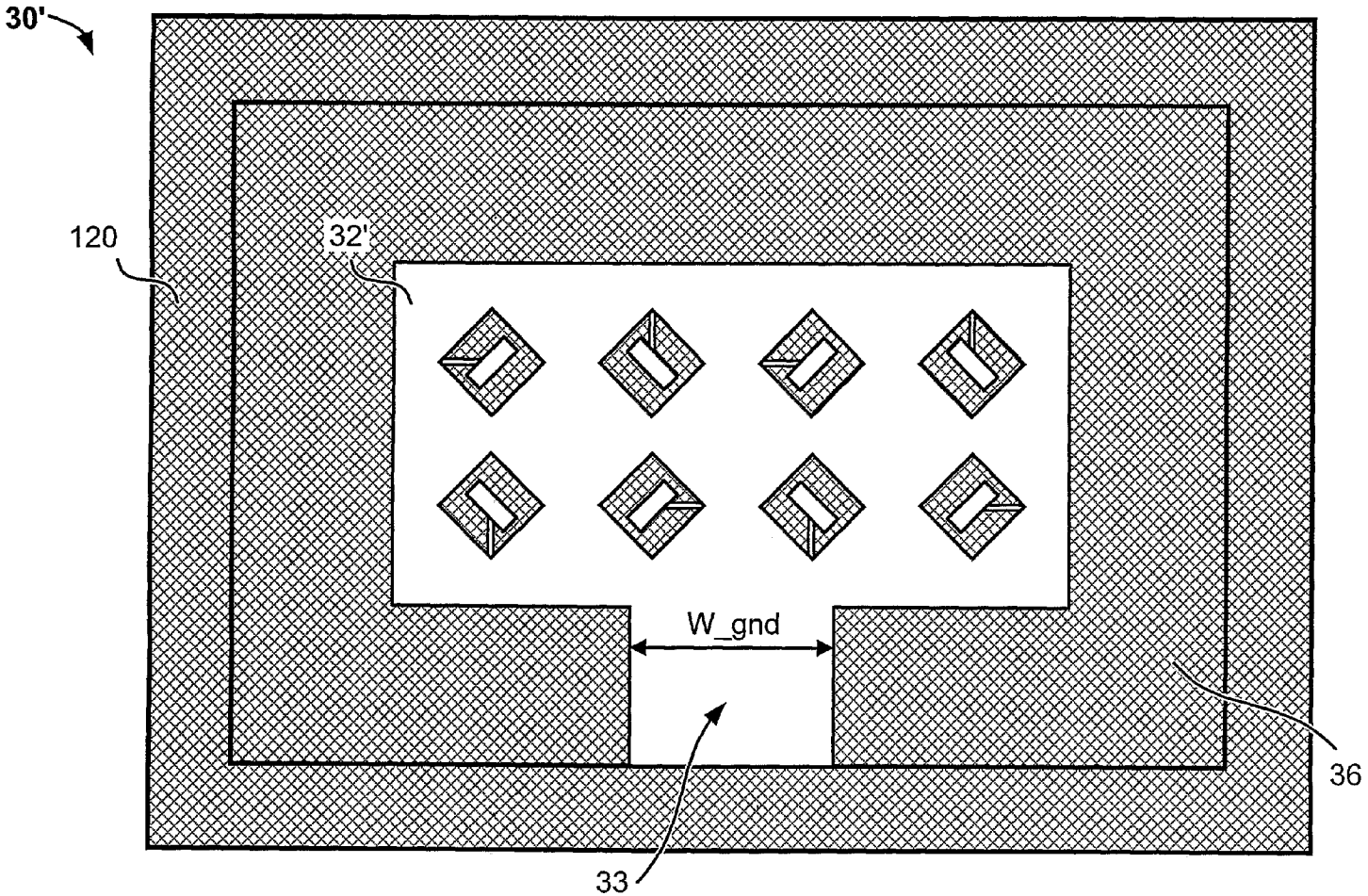
FIG. 9 is a plan view of the 4×2 array antenna assembly with an extended feed line and ground plane.
Figure 10:
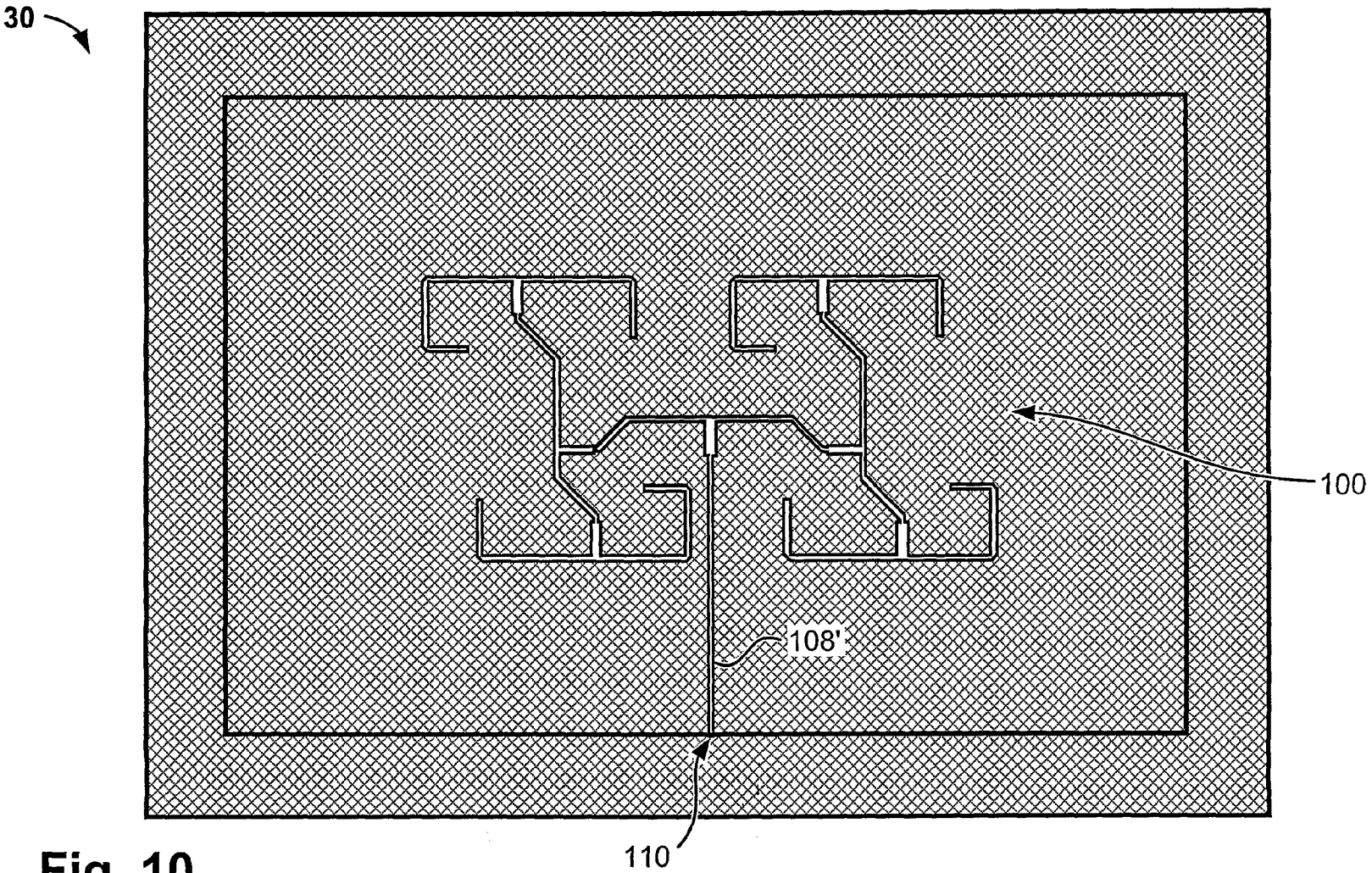
FIG. 10 is another view of the assembly of FIG. 9.

Referring now to FIG. 9, a further antenna 30' is shown. The ground plane 32' is "T-shaped" to extend to the edge of the substrate 36 to accommodate an extended microstrip feed line 108'. A supporting housing 120 also is shown. The housing provides structural integrity for the substrate 36, and can be of metal or plastics material. FIG. 10 is a view of the antenna 30' showing the feed network 100. The elements are shown as wireframe outlines so as to appear transparent. The optimal width Wgnd of the 'leg 33 is determined by a numerical simulation optimisation, and for the present embodiment a width of 5 mm is chosen. By this arrangement, a feed port 110 and ground return path are provided at the edge of the substrate which makes for easy external connection, most usually to an integrated circuit, which needs to be in close proximity to the antenna. Additionally, the leg 33 of the ground plane prevents the feed line 108' from radiating. The base of the housing (omitted in FIG. 10) forms the reflector, and therefore needs to be fabricated from a conductive material.

The array size may also be varied to suit other applications, depending upon the gain required by the antenna. In the present embodiment of 4×2 array elements, the required gain is 14 dBic. However, other applications may need less directive radiation performance and would use less array elements. For increased gain and narrower beamwidth of the antenna more elements can be used (e.g. 4×4, 8×8, 16×16, 8×2, 16×2, etc.). For best axial ratio bandwidth performance a minimum of 2×2 array elements are required to enable complete sequential rotation of the element in 90 degree intervals. A 2×1 array with sequential rotation is also possible but the axial ratio bandwidth is less than the 2×2 array, but better than the single element.

2×2 Array Assembly Embodiment

Figure 11:
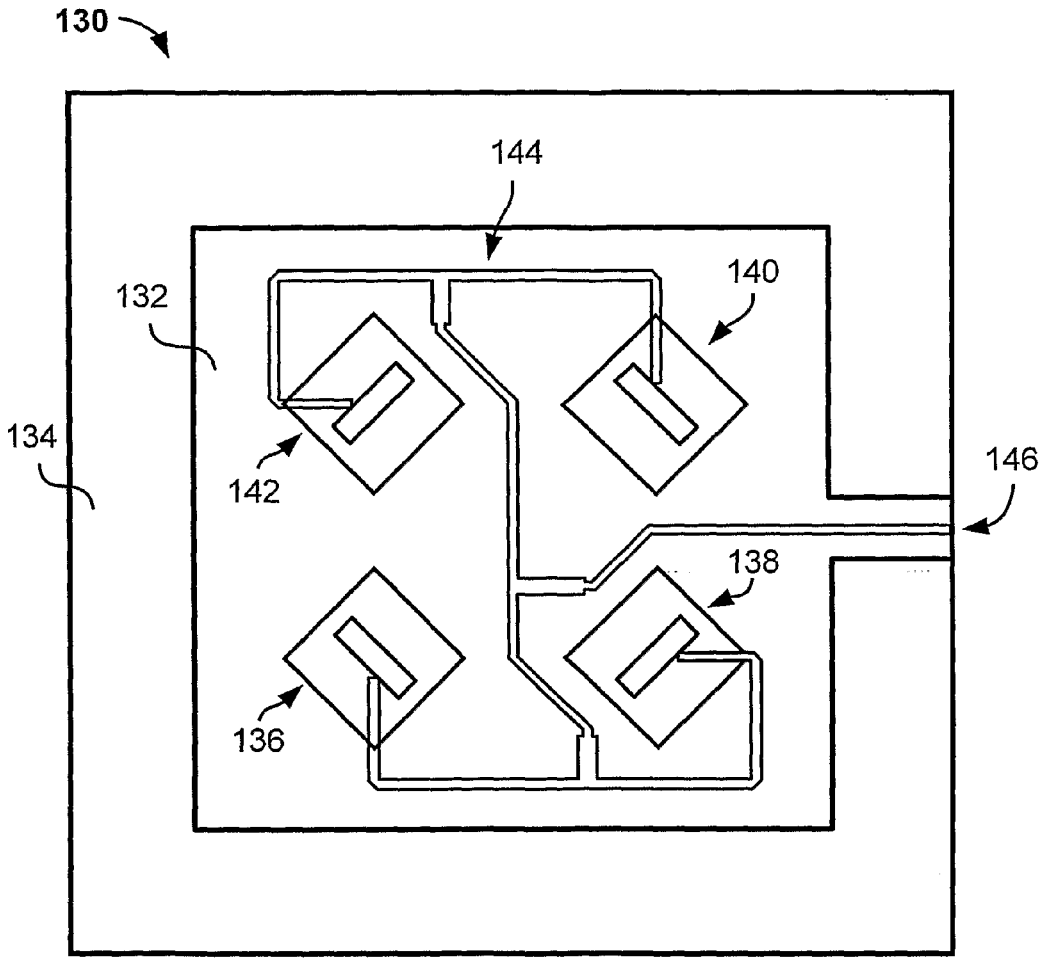
FIG. 11 is a plan view of a 2×2 array of patch-loaded square slot antenna assembly.

A 2×2 array antenna assembly 130 is shown in FIG. 11, where the elements are shown as wireframe outlines so as to appear transparent. The ground plane 132 extends over a portion of the substrate 134. The antenna elements 136-142 are shown in phantom with reference to the feed network 144 and feed port 146.

4×4 Array Assembly Embodiment

Figure 12:
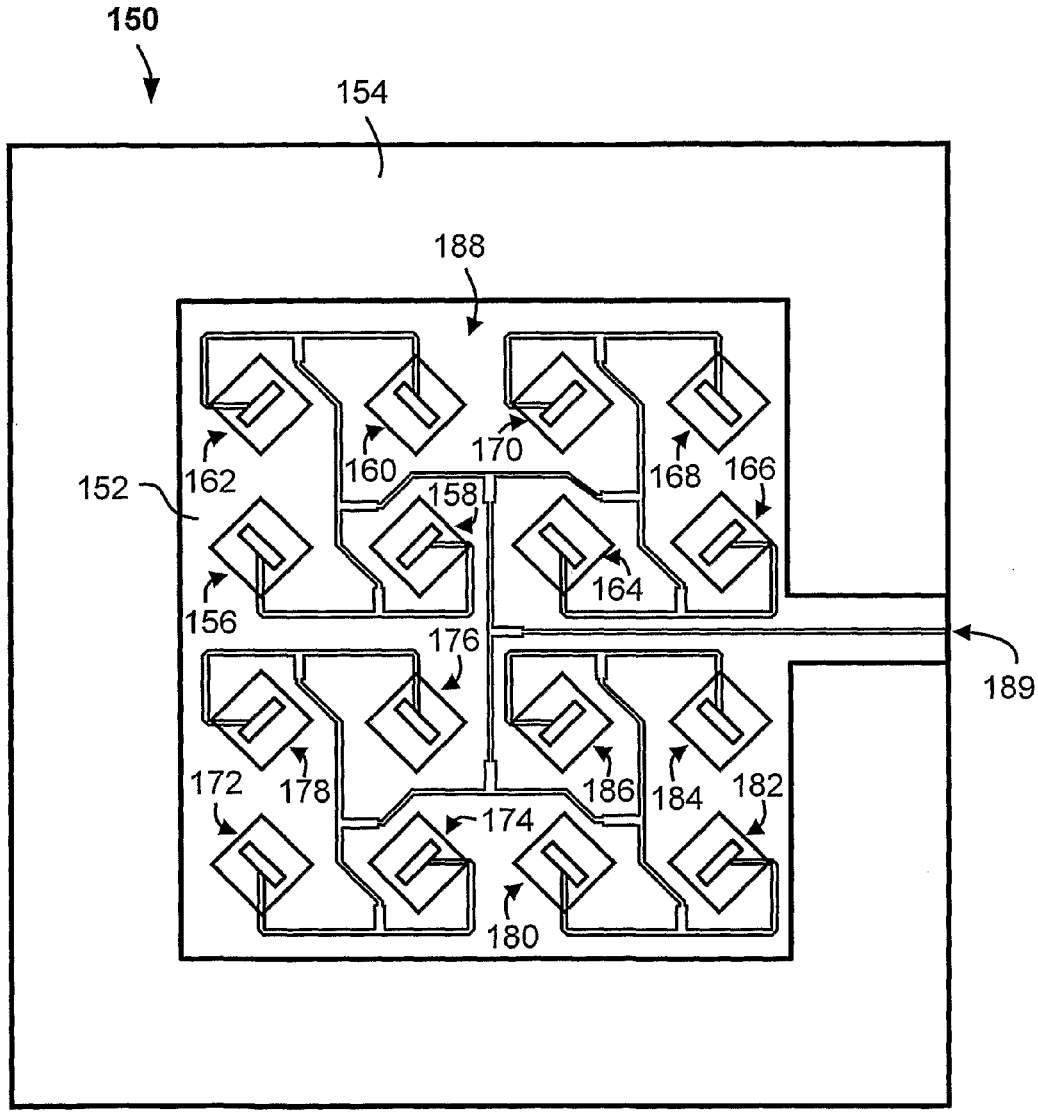
FIG. 12 is a plan view of a 4×4 array of patch-loaded square slot antenna assembly.

A 4×4 array antenna assembly 150 is shown in FIG. 12, where the elements are shown as wireframe outlines so as to appear transparent. The ground plane 152 extends over a portion of the substrate 154. The antenna elements 156-186 are shown in phantom with reference to the feed network 188 and feed port 189.

8×2 Array Assembly Embodiment

Figure 13:
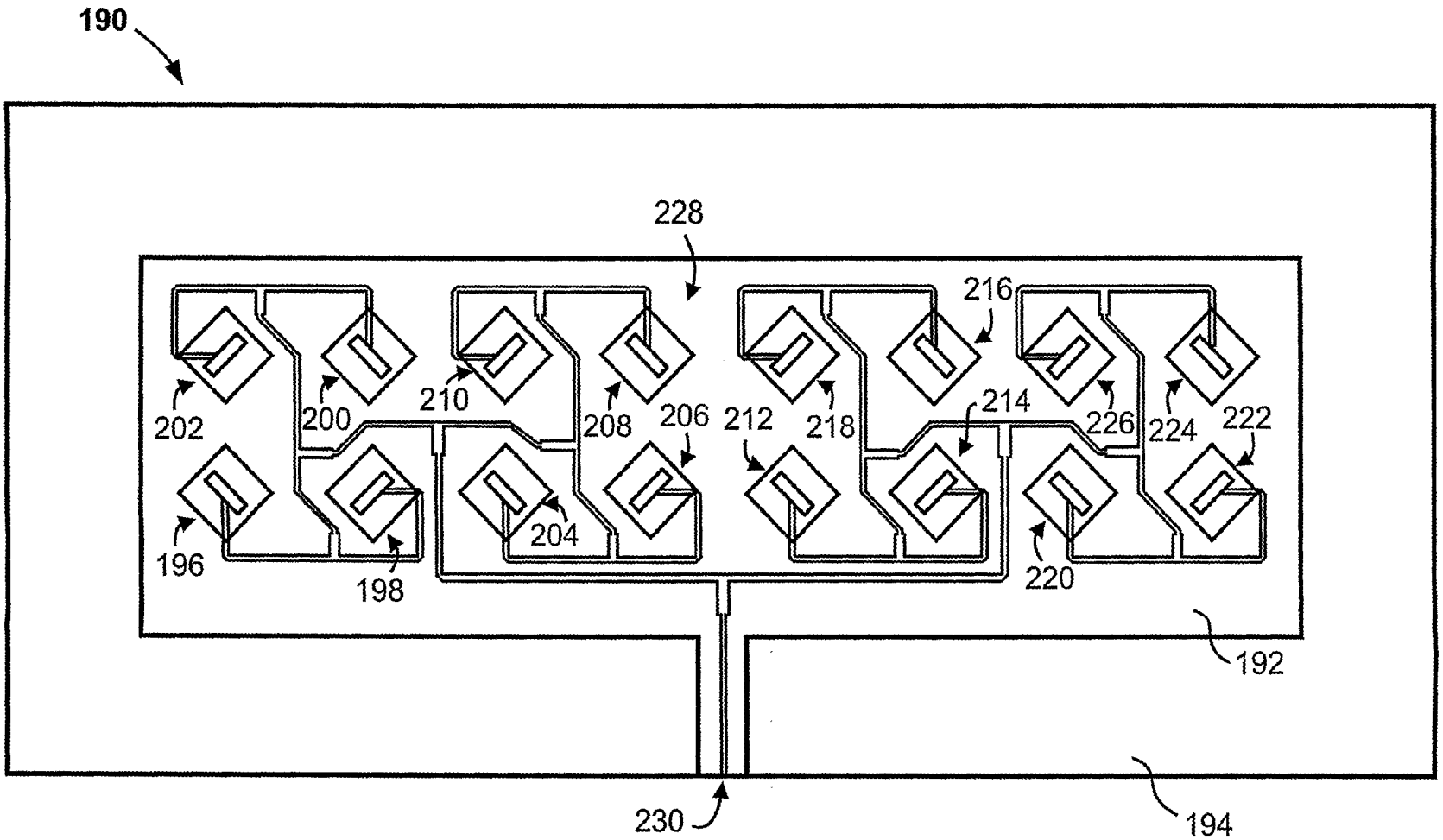
FIG. 13 is a plan view of an 8×2 array of patch-loaded square slot antenna assembly.

A 8×2 array antenna assembly 190 is shown in FIG. 13, where the elements are shown as wireframe outlines so as to appear transparent. The ground plane 192 extends over a portion of the substrate 194. The antenna elements 196-226 are shown in phantom with reference to the feed network 228 and feed port 230.

Alternative 2×2 Array Assembly Embodiment

Figure 14:
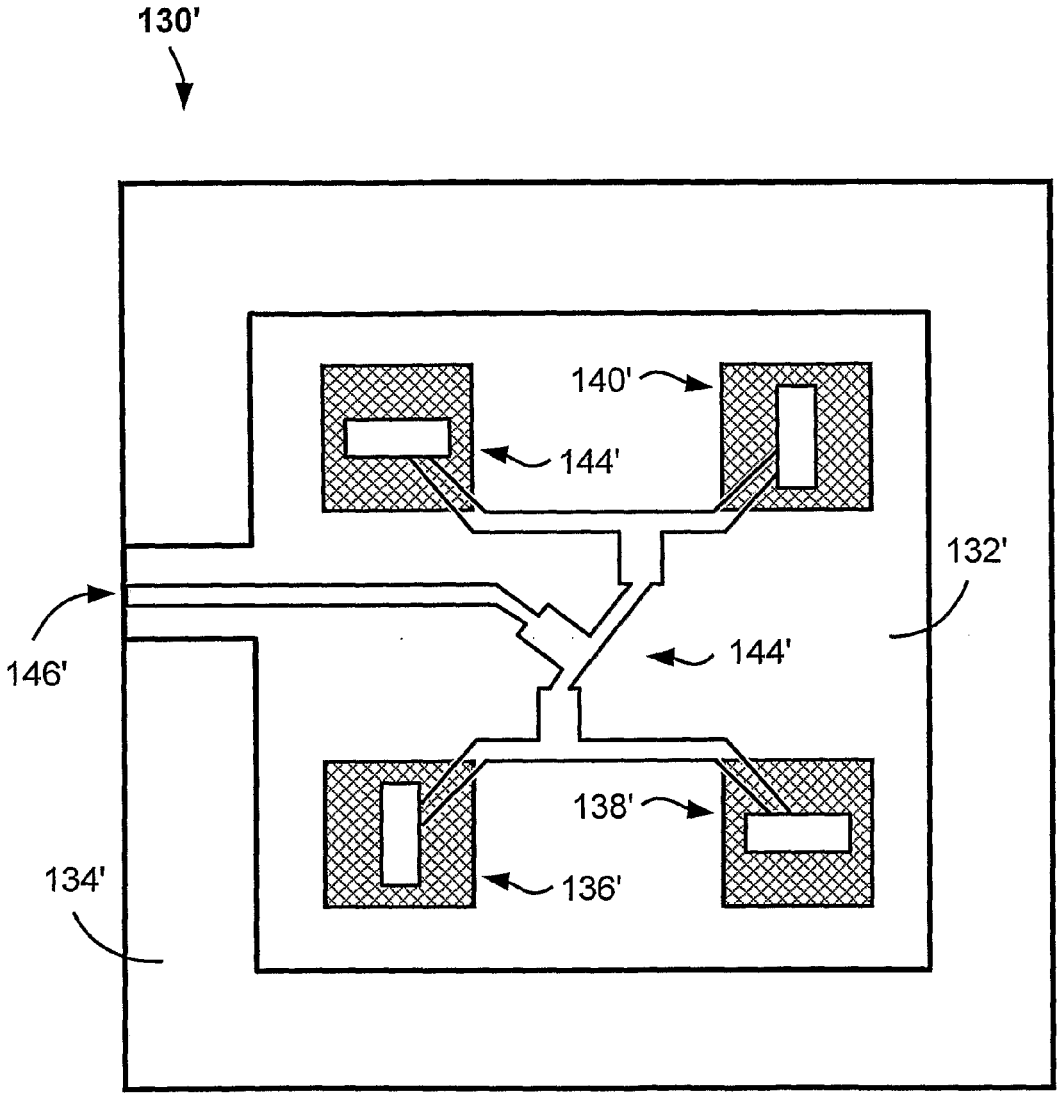
FIG. 14 is a plan view of another 2×2 array of patch-loaded square-slot antenna assembly.

The array layout used may also be varied. Referring again to FIG. 11, note that the edges of the square slots are at 45 degrees compared to the x and y axes, and the microstrip feed lines are parallel to these axes. It is also possible to have the edges of the slots parallel to the x and y axes, and the microstrip feed line at 45 degrees. This variation is illustrated for a 2×2 array antenna assembly shown in FIG. 14. This orientation of the slots allows a closer spacing of the array elements 136'-142', and uses a more compact feed network 144'. The feed port 146' is shown. Closer element spacing is advantageous to reduce sidelobe levels in the radiation pattern, and to avoid grating lobes when steering the beam in phased-array applications.

OTHER EMBODIMENTS

Figure 15I:
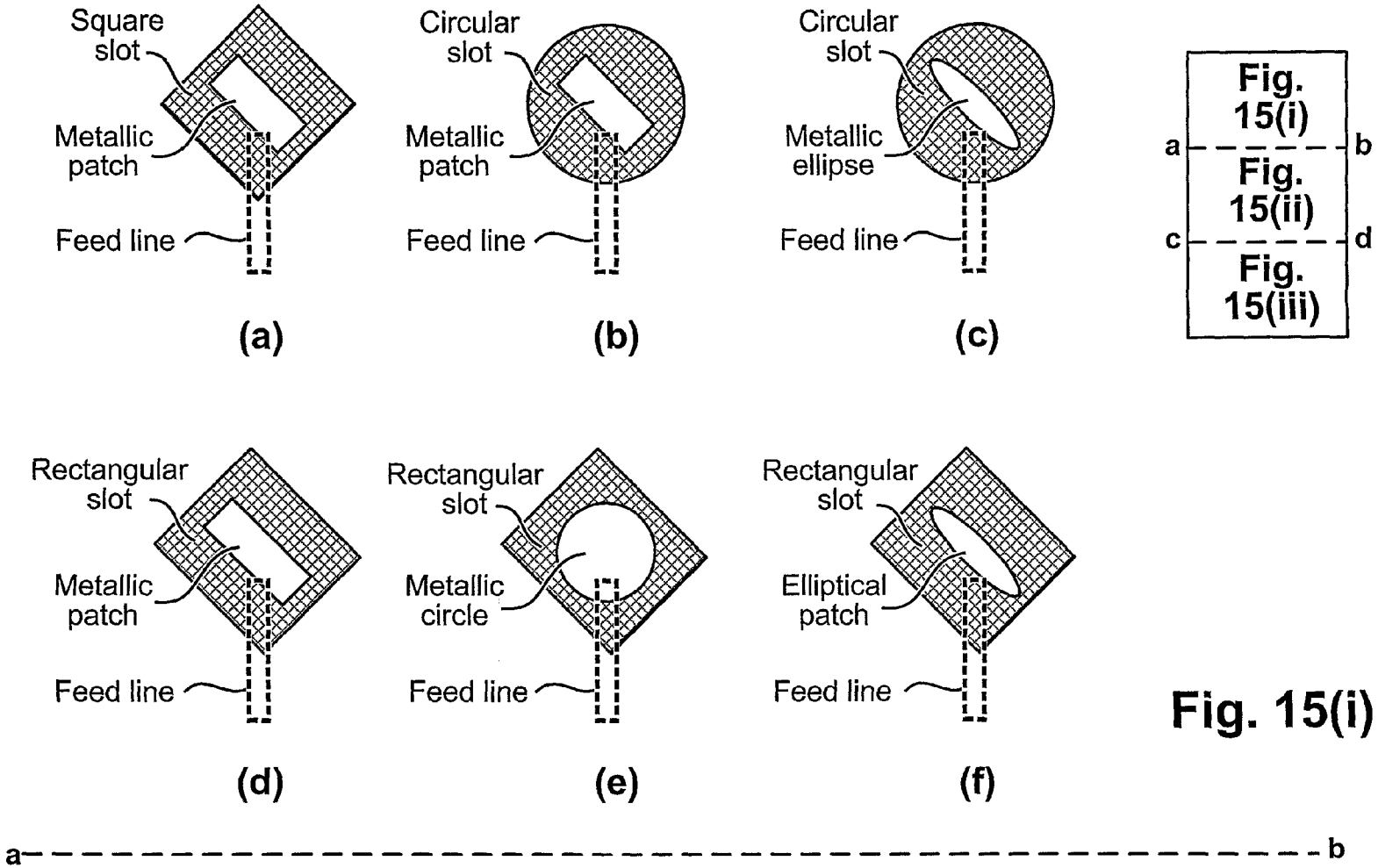
FIG. 15 shows various other antenna element embodiments.
Figure 15:
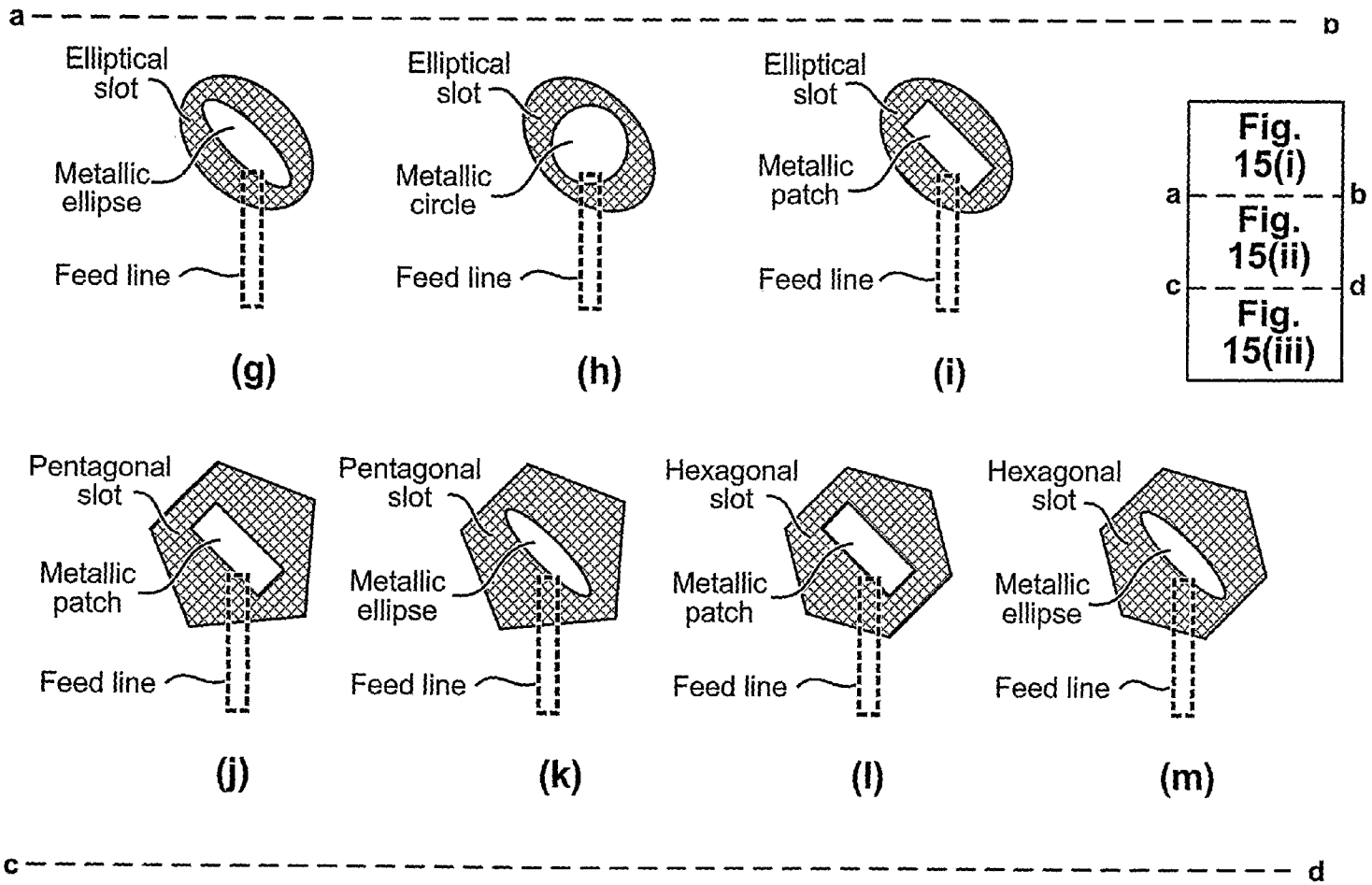

A diagram of some of the possible variations on the basic array element is shown in FIG. 15, in which: (a) patch-loaded square-slot (FIGS. 3 and 4), (b) patch-loaded circular-slot, (c) ellipse-loaded circular-slot, (d) patch-loaded rectangular-slot, (e) circle-loaded rectangular-slot (f) ellipse-loaded rectangular-slot, (g) ellipse-loaded elliptical-slot, (h) circle-loaded elliptical-slot, (i) patch-loaded elliptical-slot, (j) patch-loaded pentagonal-slot, (k) ellipse-loaded pentagonal-slot, (l) patch-loaded hexagonal-slot, (m) ellipse-loaded hexagonal-slot, (n) patch-loaded heptagonal-slot, (o) ellipse-loaded heptagonal-slot, (p) patch-loaded octagonal-slot, and (q) ellipse-loaded octagonal-slot.

In general, the slot element of the antenna element may be any polygon with n sides, where n is greater than three. This polygon may be loaded by either a planar metallic ellipse or a planar metallic patch, where the ratio between the major and minor axes of the ellipse or patch determines the circular polarization and hence the axial ratio of the element. The loading element may also be a polygon with n sides (n is greater than three) that contains a perturbation to its shape such that it also has a major axis and a minor axis to control the axial ratio of the antenna.

The invention claimed is:

1. An antenna comprising:

a single layer dielectric substrate;

a ground plane located on the upper surface of the substrate and covering only part of said upper surface;

a plurality of antenna elements also located on said upper surface of the substrate, each antenna element having a slot element formed in the ground plane and a respective loading element located within each slot element, said antenna elements being arranged in a regular array where each respective slot element is sequentially rotated in space with respect to adjacent slot elements, and said loading elements generate a perturbation under excitation;

a microstrip feed network located on the underside of the substrate to provide excitation to each slot element, and including feeds of different lengths to be electrically sequentially rotated in common with spatial rotation of said slot elements, and a single microstrip feed line extending to an edge of said substrate for connection purposes; and a reflector located parallel to and spaced apart from the underside of the substrate;

wherein said ground plane extends to cover the entire microstrip feed array, and said ground plane covers said substrate to the extent that at least ½ wavelength at an operational frequency between the edges of the ground plane and the edges of the substrate is not covered, except where said ground plane covers said single microstrip feed line.

2. An antenna according to claim 1 wherein said reflector is at least as large in surface area as said substrate.

3. An antenna according to claim 1 where said regular array is at least a 2×1 array.

4. An antenna according to claim 1 further comprising a housing that supports said substrate at the substrate edges and supports or incorporates said reflector.

5. An antenna according to claim 1 wherein said substrate is formed of a liquid crystal polymer material.

* * * * *